US006238263B1

(12) United States Patent
Bennett

(10) Patent No.: US 6,238,263 B1
(45) Date of Patent: May 29, 2001

(54) DEVICE FOR SOOTHING, DISTRACTING AND STIMULATING A CHILD

(76) Inventor: Richard Bennett, 2846 E. Brookglen, Sandy, UT (US) 84092

( * ) Notice: Subject to any disclaimer, the term of this patent is extended or adjusted under 35 U.S.C. 154(b) by 0 days.

(21) Appl. No.: 09/377,658

(22) Filed: Aug. 19, 1999

(51) Int. Cl.[7] ..... A63H 11/00
(52) U.S. Cl. ..... 446/330; 446/297; 446/298
(58) Field of Search ..... 446/81, 297, 298, 446/330, 484, 486, 485, 76

(56) References Cited

U.S. PATENT DOCUMENTS

| | | | | |
|---|---|---|---|---|
| 2,700,251 | | 1/1955 | Bertaux | 446/3 |
| 2,792,696 | * | 5/1957 | Stayart | 215/11.1 |
| 2,794,298 | | 6/1957 | Mason | 446/392 |
| 2,932,821 | | 4/1960 | Horton | 340/384.1 |
| 3,808,418 | * | 4/1974 | Conard et al. | 446/369 |
| 4,124,022 | | 11/1978 | Gross | 600/28 |
| 4,219,957 | | 9/1980 | Kakuta | 446/230 |
| 4,267,551 | | 5/1981 | Dankman et al. | 340/384.3 |
| 4,294,035 | * | 10/1981 | Klein | 446/397 |
| 4,376,935 | * | 3/1983 | Castaldo | 340/571 |
| 4,606,328 | | 8/1986 | Thoman | 600/27 |
| 4,718,876 | * | 1/1988 | Lee | 446/295 |
| 4,734,074 | * | 3/1988 | Kinberg et al. | 446/184 |
| 4,737,131 | | 4/1988 | Sirota | 446/130 |
| 4,777,938 | | 10/1988 | Sirota | 600/27 |
| 4,889,514 | * | 12/1989 | Auer et al. | 446/230 |
| 4,917,647 | * | 4/1990 | Wetherell | 446/297 |
| 4,941,857 | * | 7/1990 | Fujimaki | 446/353 |
| 5,022,384 | | 6/1991 | Freels | 601/57 |
| 5,074,820 | * | 12/1991 | Nakayama | 446/29 |
| 5,108,361 | | 4/1992 | Hein | 600/28 |
| 5,135,423 | | 8/1992 | Chung | 446/26 |
| 5,152,708 | | 10/1992 | Claugus et al. | 318/114 |
| 5,199,920 | * | 4/1993 | Christen | 446/419 |
| 5,277,644 | | 1/1994 | Osborne et al. | 446/219 |
| 5,356,329 | * | 10/1994 | Thornell | 446/485 |
| 5,471,192 | * | 11/1995 | Dash | 340/384.3 |
| 5,842,901 | * | 12/1998 | Montgomery | 446/77 |
| 5,984,098 | * | 11/1999 | Cahen | 206/457 |
| 5,989,091 | * | 11/1999 | Rodgers | 446/153 |
| 6,022,262 | * | 2/2000 | Gill | 446/227 |

FOREIGN PATENT DOCUMENTS 004025407A 2/1992 (DE) .

* cited by examiner

*Primary Examiner*—Jacob K. Ackun, Jr.
*Assistant Examiner*—Kat Fernstrom
(74) *Attorney, Agent, or Firm*—Thorpe North & Western, LLP

(57) ABSTRACT

A device for soothing, stimulating, distracting and captivating a child has a body with a rigid body wall defining an interior cavity and including a first circular wall and cylindrical perimeter wall. The first circular wall has an outer surface with a light color and a plurality of indentations formed in the surface configured for casting shadows on the light color of the surface and creating contrast between the shadows and the light color. The indentations are sized and shaped to form a human face including first and second indentations forming eyes and a third indentation forming a mouth to stimulate the child. A pair of broadly rounded protrusions extend from opposite sides of the body forming handles and being generally configured to define human ears. A vibration mechanism is disposed in the interior cavity of the body for vibrating the body. A light source is disposed on the body wall for emitting light. A sound generator is disposed in the interior cavity of the body for emitting sound. A power source is disposed in the interior cavity of the body and electrically coupled to the vibration mechanism, light source, and sound generator. A switch mechanism is operatively coupled between the power source and the vibration mechanism, light source, and sound generator for selectively activating the vibration mechanism, light source, and sound generator.

20 Claims, 2 Drawing Sheets

DEVICE FOR SOOTHING, DISTRACTING AND STIMULATING A CHILD

BACKGROUND OF THE INVENTION

1. The Field of the Invention

The present invention relates generally to a device for soothing, distracting, and stimulating an infant or child. More particularly, the present invention relates to a device having a human-like face formed by indentations in a light-colored surface to create shadows that contrast with the light-colored surface to captivate the infant or child, and also having a vibration mechanism, light source, and sound source to soothe and distract the infant or child.

2. The Background Art

A crying or fussing child can create numerous problems for its parents and care givers, and this is especially so when a child cries, screams, etc., in public situations, such as meetings, church services, and the like. In such situations, the crying or fussing child prevents not only the parent or care-giver, but the entire group, from paying attention to the meeting or service. Numerous toys and other objects have been developed and are used by parents in an attempt to quiet their children. For example, flannel books and small plastic toys are often brought to entertain the children and to redirect the child's attention in the event that he or she begins to cry. The problem with books and many plastic toys is that they often rely on sensory stimulation which is insufficient to distract the attention of the crying or fussing child.

Other child amusement devices, such as rattles, are often effective in distracting the child's attention. However, as will be appreciated by parents and other care givers, a major concern with using such a device to quiet a crying child in certain public places is the noise created by the rattle material. This is especially a concern when the child is crying during a meeting, a church service, or other similar setting. Quieting a child by use of a loud rattle achieves little benefit, as the rattle becomes nearly as distracting as the crying of a child.

In addition to soothing a child, it is often necessary to occupy the child's hands. For example, in such situations such as changing diapers and administering medications, a child tends to grasp the messy diaper or medicine with his or her hands.

In addition to calming or distracting a child, there has been a renewed interest in stimulating or otherwise captivating the child, and to promote various physical and mental developments.

An additional concern to parents is the safety of their children's toys. It is desirable that any toy or device used by a child be free of small objects which may choke a child, or be free of substances which are toxic, such as paint. As parents and care givers will appreciate, any toy or other object which a child obtains immediately finds its ways to a child's mouth.

Therefore, it would be advantageous to develop a device capable of soothing and distracting a child or infant, which does not itself create any disturbance located near the child. It would also be advantageous to develop such a device sufficiently small that it can be held by a small child or infant, but not so small as to fit completely within the mouth of the child to present a danger of choking. It would also be advantageous to develop such a device which is free of dangerous or toxic components. It would also be advantageous to develop such a device for not only soothing and distracting a child, but also stimulating the child's physical and mental growth.

OBJECTS AND SUMMARY OF THE INVENTION

It is therefore an object of the present invention to provide a device for soothing, stimulating, distracting and captivating a child.

It is another object of the present invention to provide such a device which is safe for a child's use.

It is another object of the present invention to provide such a device for stimulating the child's physical senses and mental abilities.

The above objects and others not specifically recited are realized in a specific illustrative embodiment of a device for soothing, stimulating, and captivating a child. The device has a rigid, disk-shaped body with a rigid body wall defining an interior cavity and including a first circular wall or face. The first circular wall advantageously has an outer surface with a light color and a plurality of indentations formed in the surface configured for casting shadows on the light color of the surface, and creating contrast between the shadows and the light color. The indentations advantageously are sized and shaped to form a human face including first and second indentations forming eyes and a third indentation forming a mouth. The human face captivates the child while the contrasting dark shadows and light colored surface attract the child's eyes, without the use of paint.

A pair of broadly rounded protrusions extend from opposite sides of the body. Each protrusion has a perimeter edge to form a handle sized to be grasped by a child's hands, and/or extend into a child's mouth such that the child may easily grasp the device, and may use the device for teething. The protrusions are positioned on opposite sides of the human face and are generally configured to define human ears.

In accordance with one aspect of the present invention, a vibration mechanism is disposed in the interior cavity of the body and operatively coupled to the body wall for vibrating the body to soothe, calm and distract the child. A light source is disposed on the body wall for emitting light to stimulate the child and capture the child's attention. A sound generator is disposed in the interior cavity of the body for emitting sound for capturing the child's attention. A power source is disposed in the interior cavity of the body and electrically coupled to the vibration mechanism, light source, and sound generator. A switch mechanism is operatively coupled between the power source and the vibration mechanism, light source, and sound generator for selectively activating the vibration mechanism, light source, and sound generator, such that any combination of the vibration mechanism, light source, and sound generator may be activated.

In accordance with another aspect of the present invention, the switch mechanism may comprise three separate switches for individually and separately activating one of the vibration mechanism, light source, or sound generator. The switches maybe disposed between the protrusions above the first and second indentations and have a hair-like configuration.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
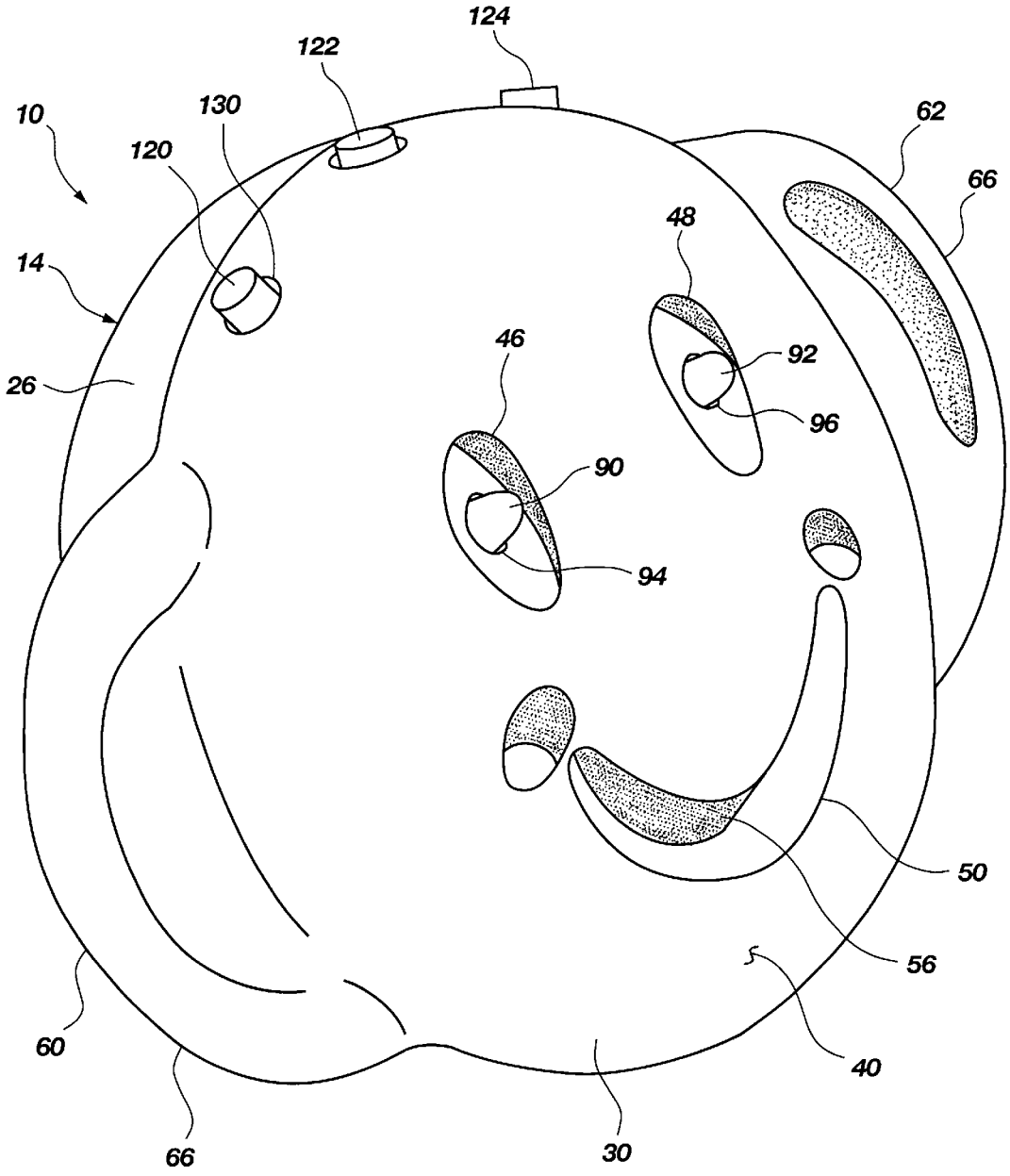
FIG. 1 is a perspective view of a preferred embodiment of a device in accordance with the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Figure 2:
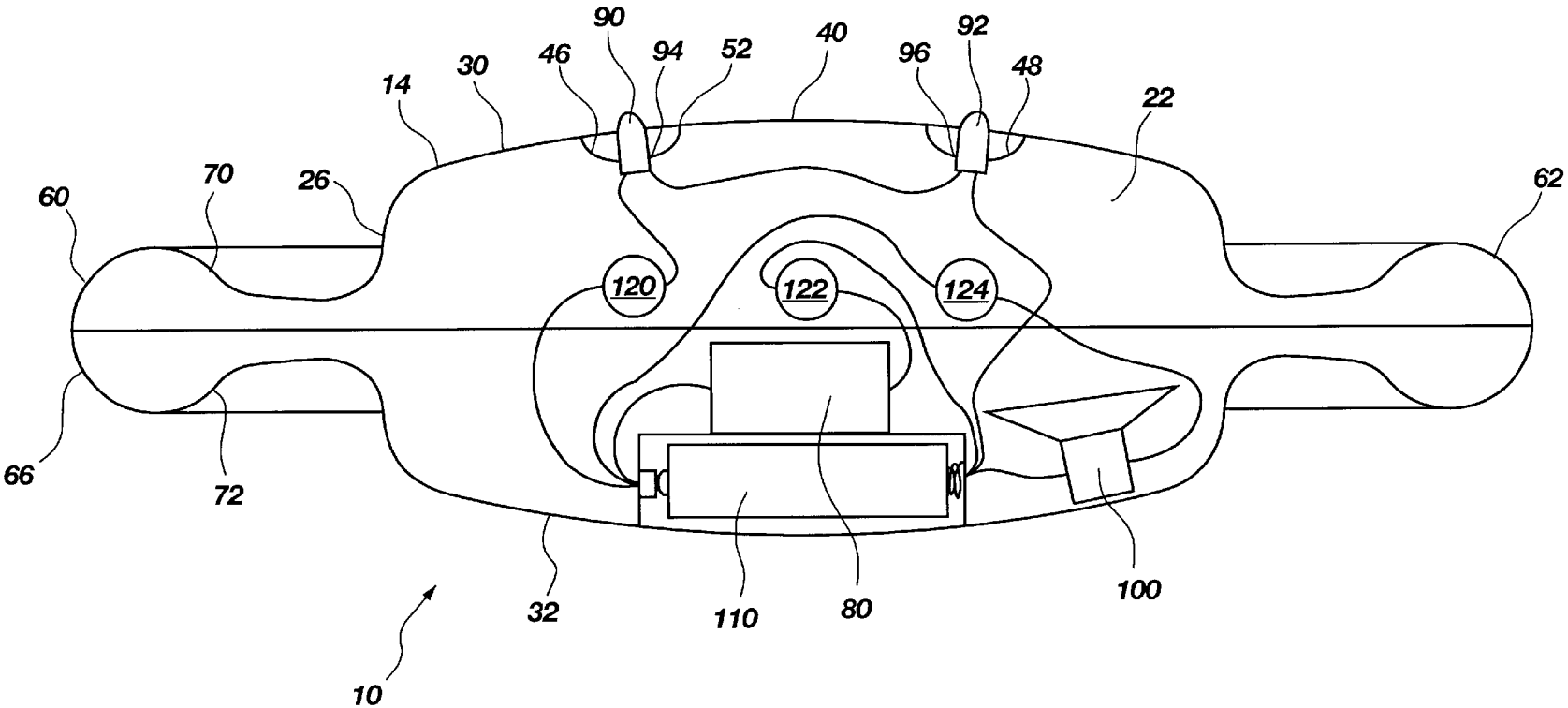
FIG. 2 is a cross sectional view of a preferred embodiment of a device in accordance with the present invention.

As illustrated in FIGS. 1 and 2, a device, indicated generally at 10, in accordance with the present invention is shown for soothing, stimulating, distracting and captivating a child or infant. The device 10 is intended to calm or distract a fussy baby. The device 10 quickly subdues the unwanted behavior, at least temporarily, and gives the parent or care-giver the time needed to accomplish a task. The device 10 has a body 14 with a body wall 18 defining an interior cavity 22. Preferably, the body 14 is rigid and has a disk shape, or round or circular shape to define a human or human-like head. The body wall 18 is preferably rigid and includes a cylindrical perimeter wall 26 and opposite first and second circular walls 30 and 32 disposed at opposite ends of the circular perimeter wall 26. The first and second circular walls 30 and 32 are preferably broadly rounded, or have a convex curvature. In addition, an edge is formed between the circular walls 30 and 32 and the cylindrical perimeter wall 26 which preferably is gradually curved, so that the disk shaped body 14 does not have any sharp edges. The body 14, or circular walls 30 and 32, preferably have a diameter or similar dimension sized substantially the same as a child's head, such that the body 14 is similar in size to a child's head.

The body 14 is preferably formed of a rigid plastic material so that vibrations may be transferred through the body 14 to the child, as discussed more fully below. In addition, the body 14 may be formed of two halves, such as an upper and a lower half, joined together to form the body with the interior cavity 22 therebetween.

The first circular wall or face 30 has an outer surface 40. The outer surface 40 preferably has a light color, such as white, or a similar light or pastel color. The first circular wall or face 30 may be formed of a light colored plastic material. Alternatively, the outer surface 40 may be painted a light color, but the material of the first circular wall 30 is preferably a light colored material to prevent scratching or peeling of a painted material from the surface 40.

The circular wall or face 30, or the outer surface 40, advantageously is shaped and/or contoured to form a human or human-like face. Preferably, the shapes and/or contours are sized proportional to the first circular wall 30, or body 14. Thus, the human or human-like face formed by the contours is substantially sized the same as a child's facial features. The facial features, such as eyes or a mouth, may be exaggerated, over-sized, or animated. It is believed that infants and young children have a natural affinity towards human or human-like faces. Infants and young children appear to be captivated by a person's face. Thus, the human or human-like face formed by the contours on the first circular wall 30 or surface 40 helps to captivate the infant or child and maintain his or her interest.

As indicated above, the first circular wall 30 and outer surface 40 preferably are substantially smooth and broadly curved, or convex. Thus, there are no sharp protrusions which may injure a child. Advantageously, there are a plurality of indentations formed in the surface 40 of the first circular wall 30. The plurality of indentations include first and second indentations 46 and 48 sized and shaped to form and define human or human-like eyes. The indentations further include a third indentation 50 sized and shaped to form and define a human or human-like mouth. The indentations preferably are concave and form a sharp or abrupt edge 52 with the surface 40. The plurality of indentations cast shadows 56 on the light color of the surface 40, or within the indentations themselves. The sharp or abrupt corners 52 help create a sharp contrast between the shadows 56 and the light color of the surface 40. The shadows 56 and light color of the surface 40 create contrasting dark and light colors. It is believed that the developing eyes of infants and young children are better able to discern images that have sharp or well defined contrast, and light and dark colors. Infants tend to fixate or be more interested in objects with sharp or crisp dark and light, or black and white, colors. Thus, the shadows 56 and light colored surface 40 of the present invention help to stimulate the visual senses of the infant or child. In addition, the indentations form facial features without creating protrusions which may injure a child. Furthermore, the sharp or abrupt edges 52 between the indentations and the surface 40 help create a sharp contrast between the light colored surface 40 and the shadows 56 created by the indentations.

A pair of broadly rounded protrusions 60 and 62 extend from opposite sides of the body 14, or the cylindrical perimeter wall 26. The protrusions 60 and 62 each have a broadly rounded perimeter edge 66. The perimeter edge 66 forms a broad curve or arc. Preferably, the protrusions 60 and 62 also include first and second opposite spaced-apart crescent shaped walls 70 and 72 forming the protrusions 60 and 62 and the perimeter edge 66. The walls 70 and 72 of the protrusions 60 and 62 preferably are concave, or thinner at their interior and thicker at the perimeter edge 66 to form handles or grips. The protrusions 60 and 62 have a thickness between the walls 70 and 72 around the perimeter edge 66 which is rounded or curved and sized to be grasped by a child's hands. In addition, the perimeter edge 66 is sized to extend into the child's mouth. Thus, the protrusions or handles 60 and 62 allow an infant or child to grasp the device 10. In addition, the protrusions 60 and 62 form a teething device or teething ring like structure that an infant may bite while teething. The protrusions 60 and 62 preferably are positioned opposite sides of the human or human-like face and generally are configured to form human or human-like ears. Thus, the rounded shape of the body 14 or first circular wall 30, the first, second, and third indentations 46, 48 and 50, and the protrusions 60 and 62 combine to form and define a generally human or human-like head with a generally human or human-like face to draw the infant's or child's attention. As indicated above, it is believed that the human or human-like face need only be representative of a human face as opposed to an actual reproduction of a human face. Thus, the features of the face, such as the indentations 46 and 48 forming the eyes, and the protrusions 60 and 62 forming the ears, may be over-sized and somewhat mis-shaped. It is also believed that over-sized facial features also assist in captivating and holding a child's attention. Thus, the face and features or indentations and protrusions may be somewhat animated or cartoon-like.

A vibration mechanism, indicated generally at 80, is disposed in the interior cavity 22 of the body 14 and operatively coupled to the body wall 18 for causing the body 14 to vibrate. The vibrating body 14 helps draw the child's attention and interest, and may also soothe the child. For example, the vibrating body 14 may be placed proximal to or abutting the child's body to provide a soothing effect, much like rocking. Vibrations also serve to immediately cease unwanted crying and fussing by captivating the child's interest. The vibrating mechanism 80 may be a motor, actuator, or the like as are well known in the art. The vibrating mechanism may be configured for operating intermittently. The intermittent operation creates a sense of anticipation in the infant or child.

A light source is preferably disposed on the body 14 or body wall 18 for emitting light to stimulate the child and capture the child's attention. Preferably, a pair of lights 90 and 92 is disposed in the human or human-like eyes. The lights 90 and 92 may be LEDs or other well known light sources. In addition, the lights 90 and 92, or other light source, may be configured to emit light intermittently or alternately between several lights. Preferably, the first circular wall defines a pair of apertures 94 and 96 extending through the first circular wall 30. The lights 90 and 92 are disposed to extend through the apertures 94 and 96. In addition, the first and second indentations 46 and 48 preferably are positioned at the pair of apertures 94 and 96. The lights 90 and 92 may extend through the apertures 94 and 96, and through the indentations 46 and 48 and protrude from the surface 40. Thus, the lights 90 and 92 may be seen from multiple positions or angles.

Preferably, a sound generator, indicated generally at 100, is disposed in the interior cavity 22 of the body 14 for emitting sound to capture the child's attention and distract the child. The sound generator may be a speaker, buzzer, or the like as are well known. The sound generator may be configured for emitting a buzz sound or musical tones, or a tune. In addition, the sound generator may be configured to operate intermittently. A power source, indicated generally at 110, is disposed in the interior cavity 22 of the body 14. The power source is preferably a battery or the like. The power source is electrically coupled to the vibration mechanism 80, the light source, or the pair of lights 90 and 92, and the sound generator 100. As indicated above, well known electrical devices may be coupled between the power source and the vibration source, and/or sound generator, to cause intermittent power.

A switch mechanism is operatively coupled between the power source 110, the vibration mechanism 80, the light source or pair of lights 90 and 92, and the sound generator 100 for selectively activating the vibration mechanism 80, the light source or pair of lights 90 and 92, and the sound generator, respectively. The switching mechanism preferably is configured such that any combination of the vibration mechanism 80, light source or pair of lights 90 and 92, and sound generator 100 may be activated. Therefore, an appropriate or desired function may be activated, while an inappropriate function may be deactivated. For example, the switching mechanism may be operated to activate the sound generator 100 in a grocery store to distract the child and/or capture his or her attention. In different situations, however, such as church services, the switching mechanism may be operated to deactivate the sound generator 100 such that the device 10 does not create a distraction for other persons. Likewise, the light source and vibration mechanism similarly may be activated for the appropriate situation or desired stimulation. For example, the light source may be deactivated during a movie.

The switching mechanism preferably includes separate switching mechanisms for each function. For example, the switching mechanism preferably includes first, second and third switching mechanisms 120, 122, and 124. The first switching mechanism 120 is operatively coupled between the power source 110 and the vibration mechanism 80. The second switch mechanism is operatively coupled between the power source 110 and the light source or pair of lights 90 and 92. The third switch mechanism is operatively coupled between the power source 110 and the sound generator 100. Therefore, the separate switch mechanisms 122 and 124 allow the individual components to be selectively and separately activated.

The first circular wall 30 or cylindrical perimeter wall 26 preferably defines three apertures, indicated at 130. The apertures preferably are located between the protrusions 60 and 62 at the top of the face. The first, second, and third switch mechanisms 120, 122, and 124 preferably are push-button type switches with the button protruding through the apertures 130. Thus, the three separate switching mechanisms 120, 122, and 124, are disposed along the cylindrical perimeter wall 26 between the protrusions 60 and 62 at the top of the face, or above the first and second indentations 46 and 48, and have a hair-like configuration, or form or define animated hair. Thus, all of the elements of the device 10, such as the handles, light source, switching mechanisms, etc., combine in a synergistic effect to create the human or human-like head and face with facial features such as eyes, ears, and hair.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A device for soothing, distracting, and stimulating a child, the device comprising:

a rigid, disk-shaped body having a rigid body wall including a cylindrical perimeter wall and opposite first and second circular walls disposed at opposite ends of the cylindrical perimeter wall, the first circular wall and cylindrical perimeter wall forming a gradual curved edge therebetween, the body wall defining an interior cavity, the first circular wall having an outer surface with a light color and a plurality of concave indentations formed in the surface configured for casting shadows on the light color of the surface in the indentation and creating contrast between the shadows and the light color, the indentations being sized and shaped to form a face including first and second indentations forming eyes and a third indentation forming a mouth to stimulate a child;

a pair of broadly rounded protrusions extending from opposite sides of the cylindrical perimeter wall of the body, the protrusions each having a broadly rounded perimeter edge and first and second opposite, spaced-apart, crescent-shaped walls, the perimeter edge being rounded and the crescent-shaped walls being concave to form handles, the protrusions having a thickness between the crescent-shaped walls sized to be grasped by a child's hands and extend into a child's mouth, the protrusions being positioned on opposite sides of the face and being generally configured to define ears;

a vibration mechanism disposed in the interior cavity of the body and operatively coupled to the body wall configured to vibrate the body to soothe and calm a child;

a light source disposed on the body wall configured to emit light to stimulate a child and capture a child's attention;

a sound generator disposed in the interior cavity of the body configured to emit sound for capturing a child's attention;

a power source disposed in the interior cavity of the body and electrically coupled to the vibration mechanism, light source, and sound generator; and a plurality of push-button type switches each operatively coupled between the power source and one of the vibration mechanism, light source, and sound generator to selectively activate the vibration mechanism, light source, and sound generator, such that any combination of the vibration mechanism, light source, and sound generator may be activated, each of the push-button type switches having a button protruding through the cylindrical perimeter wall between the protrusions and above the first and second indentations to appear as animated hair in combination with the indentations forming the face.

2. The device of claim 1, wherein the switch mechanism includes a first switch mechanism operatively coupled between the vibration mechanism and power source to selectively activate the vibration mechanism, a second switch mechanism operatively coupled between the light source and power source to selectively activate the light source, and a third switch mechanism operatively coupled between the sound generator and power source to selectively activate the sound generator.

3. The device of claim 1, wherein the first circular wall defines a pair of apertures, the first and second indentations forming the eyes are positioned at the pair of apertures, and the light source includes a pair of lights disposed in the pair of apertures.

4. The device of claim 3, wherein the lights protrude through the apertures and through the indentations past the surface of the first circular wall such that the lights may be seen from multiple positions.

5. The device of claim 1, wherein the plurality of indentations formed in the surface of the first circular wall form sharp corners with the surface to create crisp contrast between the shadows and the light color of the surface.

6. A device for soothing, distracting, and stimulating a child, the device comprising:

a body having a rigid body wall, an interior cavity, and an outer surface shaped and contoured to form a face including a pair of eyes and a mouth;

a vibration mechanism, disposed in the interior cavity of the body and operatively coupled to the body wall, configured to vibrate the body to soothe and calm a child;

a power source, disposed in the interior cavity of the body and electrically coupled to the vibration mechanism; and a push-button type switch, operatively coupled between the power source and the vibration mechanism, to selectively activate the vibration mechanism, the push-button type switch including a button extending through the body wall above the pair of eyes to appear as animated hair in combination with the eyes and mouth of the face.

7. The device of claim 6, further comprising:

a pair of protrusions, extending from opposite sides of the body wall of the body, having a perimeter edge forming a handle, and a thickness sized to be grasped by a child's hands and to extend into a child's mouth, the protrusions being positioned on opposite sides of the face and being generally configured to define ears.

8. The device of claim 6, wherein the vibration mechanism operates intermittently to create a sense of anticipation in a child.

9. The device of claim 6, further comprising:

a light source, disposed on the body wall, configured to emit light to stimulate a child and capture a child's attention; and wherein the power source is electrically coupled to the light source; and wherein the switch mechanism is operatively coupled between the power source and the light source to selectively activate the vibration mechanism and light source.

10. The device of claim 9, further comprising a pair of apertures formed in the body wall at the face, and wherein the light source includes a pair of lights disposed in the pair of apertures.

11. The device of claim 10, wherein the lights protrude through the apertures and past the surface such that the lights may be seen from multiple positions.

12. The device of claim 6, further comprising:

a sound generator, disposed in the interior cavity of the body, configured to emit sound to capture a child's attention; and wherein the power source is electrically coupled to the sound generator; and wherein the switch mechanism is operatively coupled between the power source and the sound generator to selectively activate the vibration mechanism and sound generator.

13. A device for soothing, distracting, and stimulating a child, the device comprising:

a body having a rigid body wall, an interior cavity, and a face wall with an outer surface, the face wall having a plurality of concave indentations to form a face including a pair of eyes and a mouth, the outer surface having a light color and the plurality of concave indentations having sharp edges with the outer surface to cast shadows on the light color of the surface of the indentation and create contrast between the shadows and the light color;

a vibration mechanism, disposed in the interior cavity of the body and operatively coupled to the body wall, configured to vibrate the body to soothe and calm a child;

a power source, disposed in the interior cavity of the body and electrically coupled to the vibration mechanism; and a switch mechanism, operatively coupled between the power source and the vibration mechanism, to selectively activate the vibration mechanism.

14. The device of claim 13, wherein the switching mechanism includes a push-button type switch having a button protruding through the rigid body wall above the eyes to appear as animated hair in combination with the eyes and mouth of the face.

15. The device of claim 13, further comprising:

a pair of protrusions, extending from opposite sides of the body wall of the body, having a perimeter edge forming a handle, and a thickness sized to be grasped by a child's hands and to extend into a child's mouth, the protrusions being positioned on opposite sides of the face and being generally configured to define ears.

16. The device of claim 13, wherein the vibration mechanism operates intermittently to create a sense of anticipation in a child.

17. The device of claim 13, further comprising:

a light source, disposed on the body wall, configured to emit light to stimulate a child and capture a child's attention; and wherein the power source is electrically coupled to the light source; and wherein the switch mechanism is operatively coupled between the power source and the light source to selectively activate the vibration mechanism and light source.

18. The device of claim 17, wherein the light source includes a pair of lights disposed in a pair of apertures defining the eyes.

19. The device of claim 18, wherein the lights protrude through the apertures and past the surface such that the lights may be seen from multiple positions.

20. The device of claim 13, further comprising:

a sound generator, disposed in the interior cavity of the body, configured to emit sound to capture a child's attention; and wherein the power source is electrically coupled to the sound generator; and wherein the switch mechanism is operatively coupled between the power source and the sound generator to selectively activate the vibration mechanism and sound generator.

* * * * *